US005797254A

United States Patent [19]

Walton

[11] Patent Number: 5,797,254

[45] Date of Patent: Aug. 25, 1998

[54] HIGH STRENGTH CORE FOR WIRE ROPES

[75] Inventor: John Mawson Walton, Doncaster, United Kingdom

[73] Assignee: Bridon plc, United Kingdom

[21] Appl. No.: 591,448

[22] PCT Filed: Aug. 1, 1994

[86] PCT No.: PCT/GB94/01672

§ 371 Date: Apr. 22, 1996

§ 102(e) Date: Apr. 22, 1996

[87] PCT Pub. No.: WO95/04855

PCT Pub. Date: Feb. 16, 1995

[30] Foreign Application Priority Data

Aug. 4, 1993 [GB] United Kingdom ..... 9316190

[51] Int. Cl.[6] ..... D02G 3/36

[52] U.S. Cl. ..... 57/220; 57/216

[58] Field of Search ..... 57/212, 215, 216, 57/218, 219, 220, 311, 3, 6, 9; 264/171.13, 280, 171.23, 172.12, 176.1, 290.5

[56] References Cited

U.S. PATENT DOCUMENTS

| | | | |
|---|---|---|---|
| 1,183,487 | 5/1916 | Parker | 57/220 X |
| 4,348,350 | 9/1982 | Meier et al. | 264/570 |
| 4,950,151 | 8/1990 | Zachariadas | 425/379.1 |

*Primary Examiner*—William Stryjewski
*Attorney, Agent, or Firm*—Cesari and McKenna, LLP

[57] ABSTRACT

An extruded polymeric rod is elongated in the solid state by being drawn through a forming device to produce a solid polymeric core having an orientated structure which comprises elongated crystals orientated in the axial direction of the core. The core may also comprise crystals orientated in respective radial directions. The single rod may be replaced by a bundle of rods.

10 Claims, 4 Drawing Sheets

HIGH STRENGTH CORE FOR WIRE ROPES

This invention relates to solid polymeric cores for wire ropes.

Traditionally the core or central member of a stranded wire rope was manufactured by spinning together tows of natural fibre such as sisal, usually in the form of a 3 (or 4) strand fibre rope. More recently continuous yarns of man-made fibres such as polypropylene have been substituted for the natural fibre staple, but still retaining the (3 or 4) stranded lay-up, which has the disadvantage of providing irregular support to the surrounding steel strands. In particular GB-A-1 092 321 discloses a core which consists of polyamide, polyester, or polypropylene monofilaments helically twisted together and which has been compacted under tension at a temperature above the softening point of the monofilaments.

The disadvantage of irregular support can be overcome by means of an earlier invention of the applicant, which is described in GB-A- 2 219 014 and GB-A-2 269 400, wherein a wire rope core is provided with an externally fluted surface to closely mate with the internal surfaces of the rope. The said fluted core is typically produced in two manufacturing operations using a cross-head extruder with a rotating die to form the fluted cross-sectional profile. Whilst this invention has proved very successful for medium sized ropes and has been shown to offer a product with superior service performance, it is recognised that the method is less attractive for small diameter ropes which are typically manufactured on high speed machinery. Specifically, the manufacturing method used for the fluted core is restrictive both in terms of production speed and the available material properties. It would be desirable to be able to offer a solution to these problems and provide a new type of high performance core for small diameter wire ropes, e.g. elevator ropes.

In one aspect the present invention provides a solid polymeric core for wire ropes which possesses an orientated structure in which the crystals are elongated and orientated in the axial direction.

In another aspect the invention provides a solid polymeric core for wire ropes which possesses an axially orientated structure and is polygonally shaped to correspond with the internal geometry of the rope.

In a further aspect the invention provides a solid polymeric core for wire ropes which has a structure comprising crystals orientated in two directions, that is in a direction transverse to the axis of the core as well as in the axial direction.

The core is preferably of unitary or one-piece construction, but alternative constructions comprising a plurality of elements are possible. For example, the solid elongate body may be of coaxial construction, being formed from successive layers of polymeric material (which may differ from layer to layer). In another embodiment the body may be an assembly of mutually parallel polymeric elements. In this case the number (n) of elements is preferably directly related to the number (m) of strands which are to enclose the core (e.g. n=m/2, n=m, or n=m+1).

The invention also provides a method of producing the said core in a single- or multi-stage operation using a controlled means of forming the core whilst in its solid state.

The invention further provides wire rope containing a solid polymeric core of unitary or multi-element construction in which the structure of the core material is preferentially orientated in a substantially axial direction. Preferably the core is externally profiled to correspond with the internal geometry of the rope. The wire rope may, for example, comprise 6 or 8 outer strands over the said core. The core may contribute significantly (e.g. 5%, up to 10%, or more) to the load bearing capability of the rope.

The invention will be described further, by way of example only, with reference to the accompanying drawings, in which.

Figure 2A:
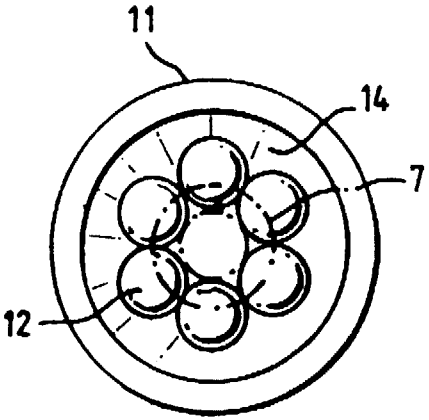
FIG. 2 is an axial cross-section through a first embodiment of forming device.
Figure 2:
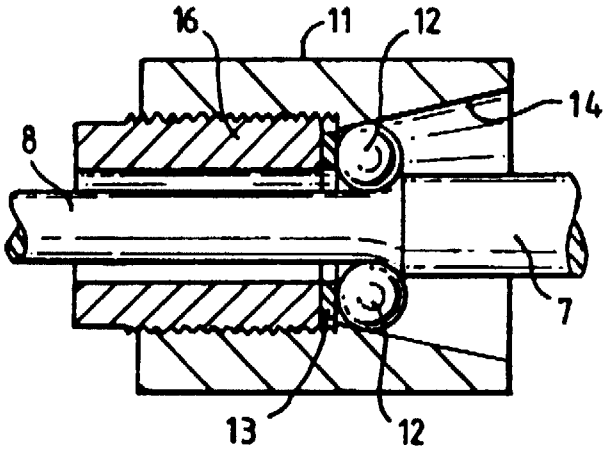
Figure 3:
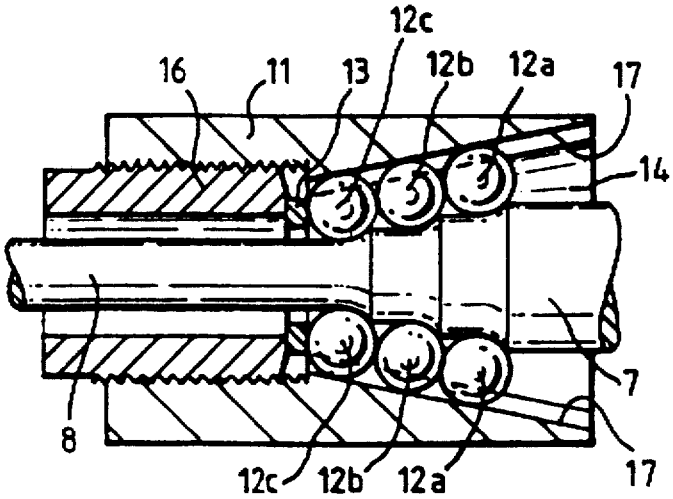
Figure 3A:
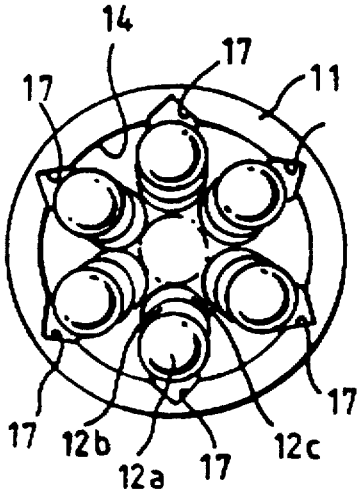

FIG. 2*a* is an end view of the forming device of FIG. 2;

FIG. 3 is an axial cross-section through a second embodiment of forming device;

FIG. 3*a* is an end view of the forming device of FIG. 3; and

Figure 4:
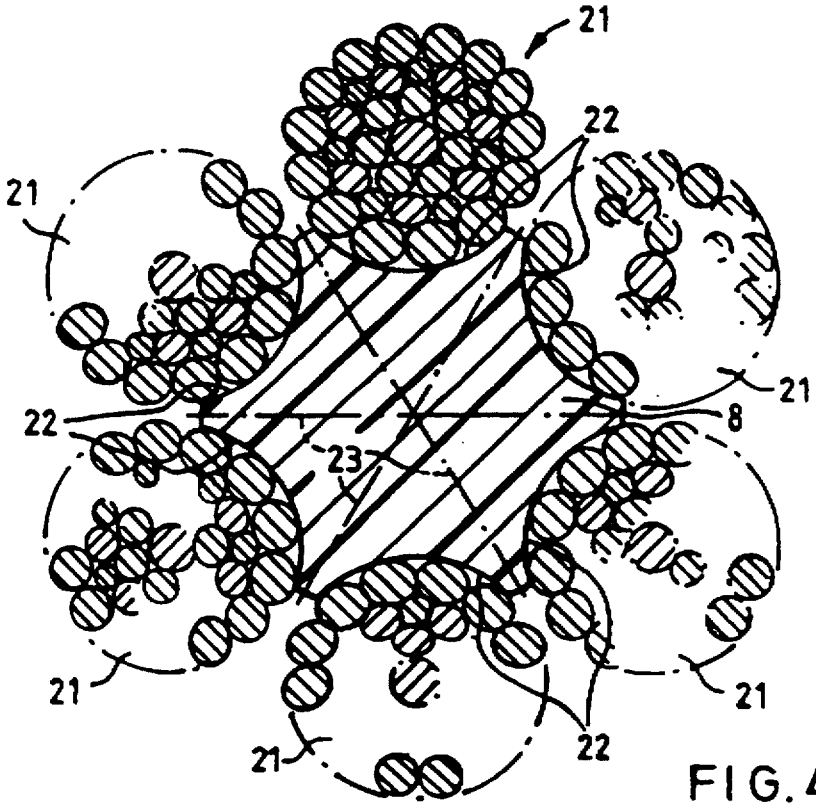
Figure 5A:
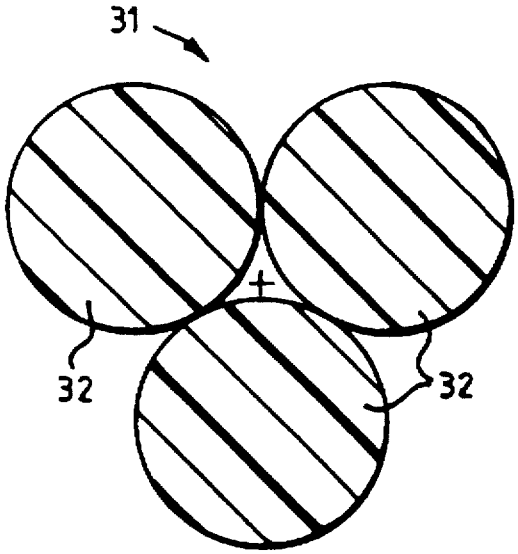
Figure 5B:
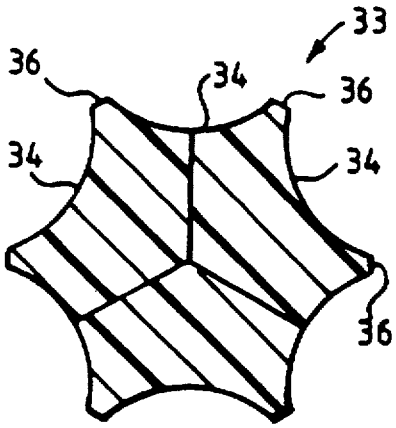
Figure 6A:
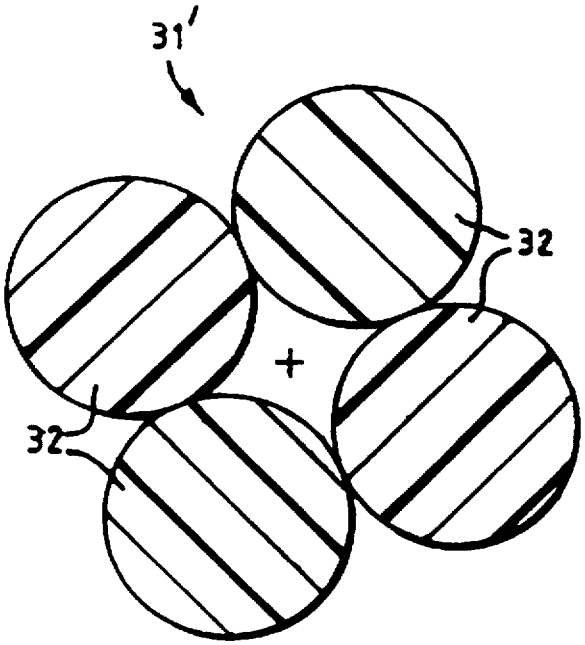
Figure 7A:
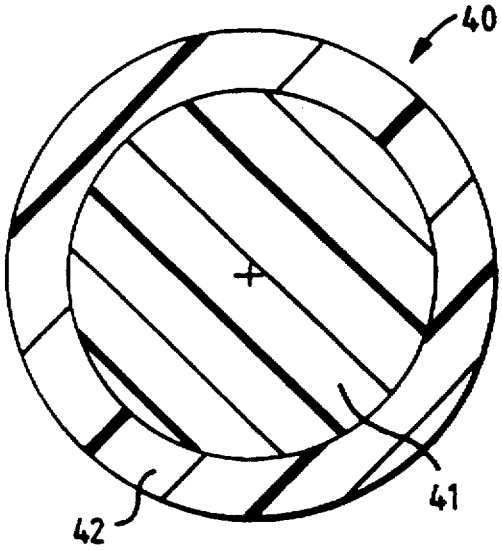
Figure 8A:
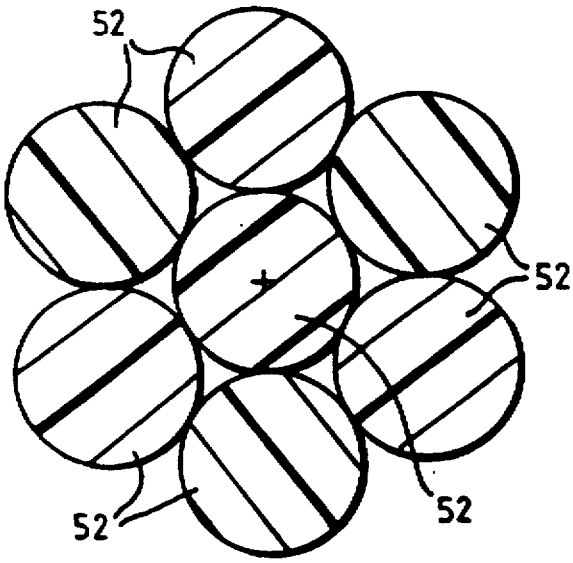

FIG. 4 is a cross-section through a wire rope including the core;

FIG. 5*a* is a cross-section-through a three-rod bundle;

FIG. 5*b* is a cross-section through the bundle of FIG. 5*a* after reduction and elongation to produce a core for a 6-strand rope;

FIG. 6*a* and *b* are views similar to FIGS. 5*a* and *b*, showing a four-rod bundle for an 8-strand rope;

FIGS. 7*a* and *b* are views similar to FIG. 5*a* and *b*, showing a two-piece core for a 6-strand rope; and FIGS. 8*a* and *b* are views similar to FIGS. 5*a* and *b*, showing a seven-rod bundle for a 6-strand rope.

What is described below is a method of manufacturing solid, high strength polymeric cores (for wire ropes) in a single process, whereas previously it has only been possible to achieve such strengths from stranded cores, produced from fine fibres in a multiplicity of separate operations, which do not offer the same solidity of support to the wire strands.

The preferred method comprises extruding a nominally cylindrical rod (or a bundle of rods) of polymeric material with a substantially greater cross-sectional area than that required in the finished core, and then applying a forming operation to the rod (or bundle) in the solid state. This forming operation is designed and controlled to both elongate the rod (or rods) in the axial sense and to reform the cross-sectional shape of the rod (or bundle) to closely match the requirements of the end product.

The process of elongating the polymeric material in its solid state substantially enhances its mechanical properties. In particular, the Tensile Strength of the elongated core may be increased for example by a factor of 10 and the elastic modulus may be increased by a factor of as much as 20 by comparison with the as-extruded rod. The reason for this is that the forming operation induces reorientation of the crystalline structure of the material, whereby the crystals are drawn out and elongated in the axial direction.

The process of reforming the cross-sectional profile has two beneficial effects. Firstly, it enables the size of the core to be closely toleranced to suit the desired rope diameter, improving both the longitudinal consistency and the concentricity of the core relative to the original extruded rod shape, which has a tendency to become oval on solidifying (unless extruded vertically). Secondly, it allows the shape of the core to be modified to closely conform to the desired internal profile of the wire rope. Hence, the core may be polygonal in cross-section, where the number of faces is chosen to match the number of strands in the rope, and the faces may be concave with a radius of curvature similar or equivalent to the strand radius.

The forming process draws out and elongates the crystals of the orientatable polymers in the axial direction, which enhances the axial properties of the core, in that the crystals become somewhat whisker-like and stronger (through strain-hardening mechanisms).

Additionally, in the process of re-shaping the core into a noncircular (polygonal) cross-sectional shape, there is inevitably some transverse distortion or flow of the polymer which may be likened to the bi-axial drawing of sheet or tubular materials. This supplemental orientation in a direction normal to the axial direction (as well as the preferential orientation in the axial direction) has the additional potential of enhancing the transverse properties of the core, for example in terms of its ability to withstand the radial (crushing) stresses exerted by the rope strands (viz. by turning some of the whiskers into ribbons).

The solid-state drawing of such a core enhances its axial strength, radial compressive strength, bending stiffness, and torsional malleability.

Figure 1:
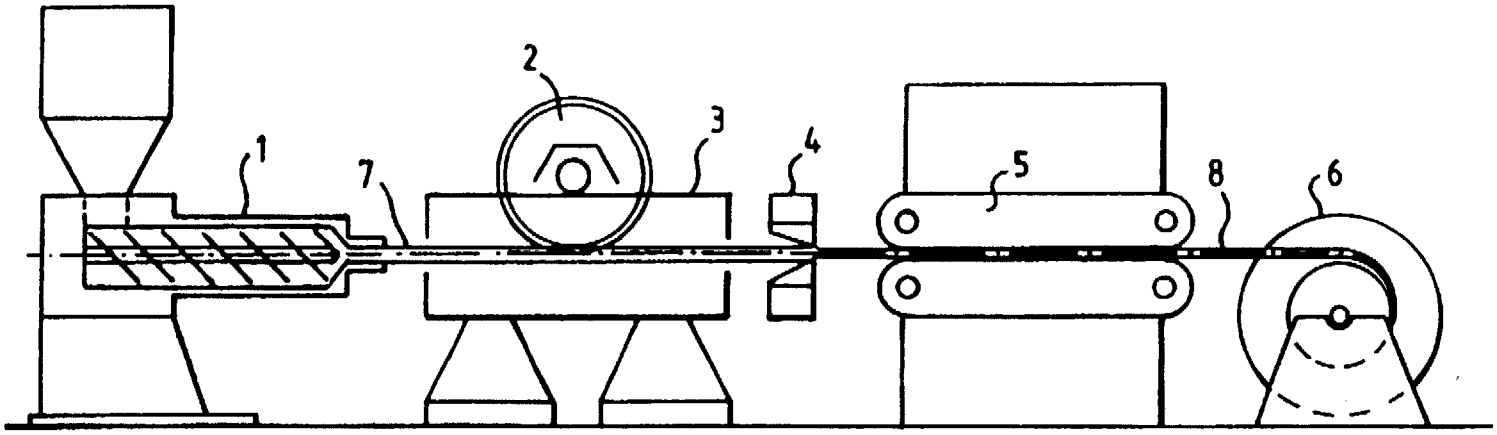
FIG. 1 is a schematic elevation of apparatus for manufacturing a core for wire rope.

FIG. 1 shows a horizontal screw extruder 1 producing a rod 7 (or a round bundle of rods). The elongation process is preferably carried out in-line with the extruder, so that the rod (or bundle) may be operated upon in its solid state but before it has had chance to cool below an optimum working temperature. This avoids the problems associated with re-heating the material up to a suitable temperature, which may be an expensive and rate-controlling operation.

The elongation process may be carried out between two traction devices which are geared to one another, e.g. by mechanical or electronic means, to maintain a predetermined ratio of linear speed. For example, if it is desired to elongate the rod (or bundle) by 100%, then the second traction device will be set to operate at twice the linear speed of the first traction device.

The first traction device may be a capstan 2 of single-drum or double-drum construction, or a "caterpillar" drive (comprising two endless friction belts), being suitable both for gripping the round rod 7 (or bundle) and for immersion in a fluid bath 3, if required for temperature control purposes. The second traction device may be either a capstan or a "caterpillar" drive 5 (comprising two endless friction belts) having regard to the shape and damage resistance of the elongated core 8 being produced. The core 8 is finally wound on a take-up reel 6.

Control of the elongation process may be enhanced by applying radial pressure over a section of the rod (or bundle) between the two traction devices, as shown schematically in FIG. 1. The pressure generating device may be a tubular die 4 (similar to a wire drawing die) or a system of shaped rollers. Because of the difficulties of providing an adjustable die or roller system, a preferred set-up procedure may be to:

(a) start up the extruder 1 and pull out a tail of material of a size capable of passing through the die 4, i.e. by drawing down of the melt at the extruder exit, (b) lead the tail around the first traction device 2, through the die 4, and on to the second traction device 5, and (c) pick up the drive with the second traction device 5 and then gradually bring in the first traction device 2 to transfer the elongation process from the extruder exit to the control region.

The extruder drive means will also preferably be linked automatically to at least one of the traction devices 2,5 in terms of relative throughput, so that the line speed may be varied without substantially changing the relative process conditions.

Control of the rod temperature during the elongation stage may be critical to the process and can best be effected by positioning a hot-water (or fluid) bath (e.g. at about 90° C.) between the extruder and the die. (or pressure generating device). A possible arrangement of the equipment is to mount the die on the end of the water (or fluid) bath. A second bath or trough (not shown) containing water (or fluid) at a lower temperature may be located after the die to assist in the cooling of the core before it encounters the second traction device.

Means for reforming the shape of the core may comprise a contoured die, a set of shaped rollers, or preferably the spherical ball forming device which is disclosed below. This has the unique advantage of being easily assembled and adjusted onto the rod (or bundle) without interrupting the process. In practice it is expected that the reforming operation will be carried out in conjunction with the elongation operation and preferably in line with the extruder. The forming device described below may therefore also constitute the means of applying radial pressure referred to above in the elongation operation. It will be recognised that extrusion is a continuous process and that in order to carry out reforming operations downstream and in-line with the extruder, it is preferable for the forming equipment to be both demountable and adjustable. These features are provided by the equipment described below.

FIG. 2 depicts the basic principle of a spherical ball device in which balls 12 are free to rotate within a housing 11 having a frustoconical bore 14, the taper of which provides the means of adjusting their spacial geometry with regard to the plastics rod 7 (or bundle of rods) which it is desired to modify the shape of and which passes through the centre of the device. The radial positioning of the ball 12 may be controlled by means of a thrust ring or washer 13 arranged normal to the axis of the conical bore 14 and provided with fine adjustment in the axial direction, e.g. by means of a carrier 16 screwed into the housing 11. The number of balls 12 will be chosen to match the number of strands in the rope for which-the core 8 is intended, and the size of the balls will be selected to give the desired profile in the finished core 8. In the limit of the core adjustment means, the balls 12 will all just touch one another and the thrust ring 13, so that their uniform positioning around the conical bore 14 is ensured.

In another embodiment the frustoconical bore 14 is provided with axially aligned or helical grooves into which the balls 12 are located. The bore grooves are preferably spaced equidistant around the conical bore so that uniform spacing of the balls is maintained even when they are not touching on another. This allows a core to be produced with a wider separation of its grooves and hence provides a rope with a more generous spacing of the strands.

In another embodiment the forming device comprises a series of annular rings of spherical balls 12*a*, 12*b*, 12*c*at reducing radial distances from the axis of the conical bore 14, to provide a progressive transformation of the rod shape, as illustrated in FIG. 3. The size of the successive balls 12*.b,c* may also reduce progressively and each annular ring of balls may be separately adjustable. In the embodiment shown, the balls are located in axially aligned equi-spaced grooves 17.

Where the ring (or rings) of spherical balls is (or are) located in grooves then the outer casing 11 may be rotatably mounted. A core having a helically grooved profile may then be produced either by providing a drive means to rotate the forming device in a geared relationship to the speed of the (final) traction means, or by arranging the successive rings of balls in a helical array, and allowing the forming means to rotate naturally, i.e. of its own accord.

It will be realised that a given size of device, i.e. casing 11, may be utilised to produce a range of core sizes. The number of balls (and hence grooves in the tapered bore, if present) will be determined by the rope construction. Coarse adjustment of core size/profile is provided by selecting an appropriate spherical ball size (or sizes) and fine adjustment is provided by means of the axial positioning of the thrust ring 13.

The spherical balls 12 (12*a–c*) will preferably be of hardened steel or other wear resistant material such as tungsten carbide, and casing 11 of hardened steel or hard bronze. The thrust ring 13 may also be a hard bronze, to minimise wear and the need for lubricant. The surface finish of the spherical balls may be advantageously controlled to encourage their rotation with the polymer (core) surface.

The angle of taper of the conical bore 14 may be advantageously selected to ensure that the balls are drawn into the housing 11 and retained there by the resultant of the shear and radial forces which act upon them without the need for a rear retaining ring or collar.

When a bundle of rods is being acted upon, each ball (or each alternate ball) will naturally run along the valley defined between two adjacent rods, thereby automatically resulting in a cross-sectional profile of rotationally symmetrical shape.

Where large reductions in the cross-sectional area of the rod (or bundle) are contemplated then a multi-stage process may be required, involving a series of traction devices with forming devices between each neighbouring part and with the necessary inter-heating or inter-cooling means to maintain the polymer temperature at an optimum level for each reduction/shaping stage, having regard to achieving economic operating speeds, e.g. greater than 10 m/min, preferably greater than 20 m/min, more preferably greater than 30 m/min.

In yet another embodiment, the final shaping and/or twisting operation on the core may be carried out on the rope closing machine, where the forming device is preferably located close to the forming point of the machine so that final adjustments can be made to the core size immediately adjacent to its introduction to the rope and can provide the ultimate control of the rope manufacturing process with respect to product size.

The use of a bundle of rods (preferably round rods) avoids the problems of extruding a single large rod. It will be appreciated that care will have to be taken to ensure that the integrity of the resulting multi-element core is maintained between the core-forming and rope-closing operations.

FIG. 4 shows a rope comprising six strands 21 wound on a core 8 having six concave surfaces 22 and containing generally whisker-like crystals orientated in the axial direction and also generally ribbon-like crystals orientated in the axial direction and in the radial directions 23 indicated.

FIG. 5*a* shows a bundle 31 of three round rods 32 which is processed by the above-described apparatus to produce the three-piece core 33 shown in FIG. 5*b* for a 6-strand rope. The core 33 has six concave surfaces 34 and contains generally whisker-like crystals orientated in the axial direction and also generally ribbon-like crystals orientated in the axial direction and in radial directions towards the protuberances 36 between the concave surfaces 34.

Figure 6B:
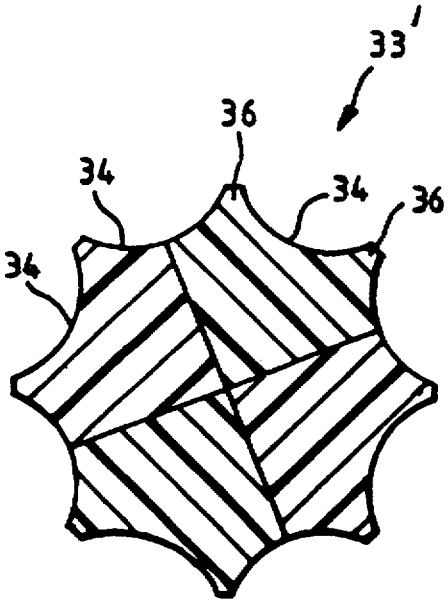

FIG. 6*a* shows a bundle 31' of four round rods 32 which is processed as described above to produce the four-piece core 33' shown in FIG. 6*b* for an 8-strand rope.

Figure 7B:
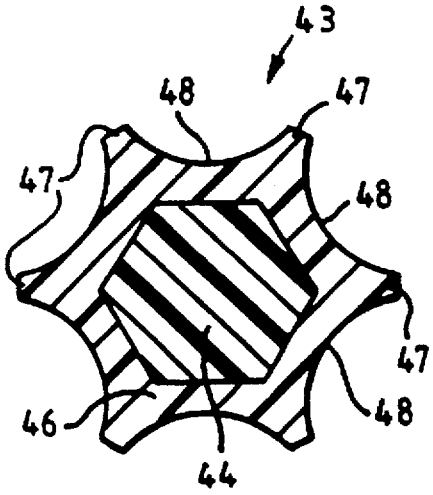

FIG. 7*a* shown a two-piece rod 40 produced by extruding a cylindrical element 41 of orientatable polymeric material and then extruding onto it an outer layer 42 of orientatable polymeric material. The two materials may be the same or different. The rod 40 is processed in the same way as the rod 7 described above to produce the core 43 shown in FIG. 7*b* for a 6-strand rope. Both the central part 44 and the outer part 46 of the core 43 comprise generally whisker-like crystals orientated in the axial direction. In addition the outer part includes generally ribbon-like crystals orientated in the axial direction and in radial directions towards protuberances 47 between concave surface 48 for receiving the strands of the rope.

Figure 8B:
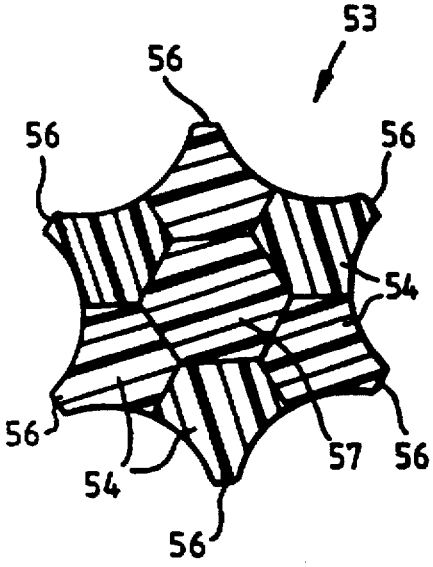

FIG. 8*a* shows a bundle 51 of seven round rods 52 which is processed as described above to produce the seven-piece core 53 shown in FIG. 8*b* for a 6-strand rope. Again, each outer element 54 of the core 53 includes generally ribbon-like crystals orientated in the axial direction and in the radial direction towards a protuberance 56. The polymeric material of the central element 57 may be different from that of the outer elements.

The above processes are particularly suited to thermoplastic materials which are amenable to solid state forming and preferably show a pronounced increase in mechanical properties by strain hardening, i.e. equivalent to cold-working in metals. It is known that the polyolefins respond favourably to such treatment, and High Density Polyethylene and Polyethylene Copolymers and Polypropylene have been shown to be suitable candidate materials. However, new and improved blends of material are constantly being produced, including (fibre) reinforced polymers, and this invention may be applied to many of them with equal benefit.

It is well known that when extruding large solid sections of some thermoplastic materials, problems can arise with intermittent shrinkage voids appearing along the axis of the rod. To avoid this problem and the consequent risks of inconsistency, especially on larger rods, it may be preferable to extrude a rod with a fine central hole or bore, which is substantially closed by the subsequent forming operation. Alternatively the rod may be extruded in a number of successive operations, as mentioned above, or a bundle of rod may be used, as explained above The cores illustrated in the drawings have been described as applied to rope constructions of single-layer type, but the cores may be used equally effectively in multi-strand ropes, i.e. ropes which comprise more than one layer of strands.

I claim:

1. A solid polymeric core for wire rope, the core having an axis and consisting of a body of polymeric material formed by simultaneous elongation and cross-sectional deformation in the solid state, the polymeric material having a structure orientated substantially in the axial direction of the core, said orientated structure including whisker-like crystals which have a length extending substantially in the axial direction of the core and ribbon-like crystals each having length extending substantially in the axial direction and a width extending substantially in a transverse direction normal to the axial direction, the body having a plurality of concave grooves which are parallel to the axis and which are equally spaced about the axis.

2. A core as claimed in claim 1, in which the structure of the polymeric material is orientated in radial directions normal to the axial direction as well as in the axial direction.

3. A core as claimed in claim 1, in which the core is of one-piece construction.

4. A core as claimed in claim 1, in which the body comprises a parallel assembly of individual longitudinal members made of polymeric material.

5. A core as claimed in claim 4, in which the longitudinal members have mutually abutting surfaces which extend inwardly from the outer surface of the core towards the axis of the core, each said surface intersecting the middle of a corresponding one of the concave grooves.

6. A solid polymeric core for wire rope, the core having an axis and consisting of a body of polymeric material having a structure orientated substantially in the axial direction of the core and also in transverse directions normal to the axial direction, the structure including whisker-like crystals which have a length extending substantially in the axial direction of the core and ribbon-like crystals each having a length extending substantially in the axial direction and a width extending substantially in a transverse direction normal to the axial direction, the body having a plurality of concave grooves which are parallel to the axis and which are equally spaced about the axis.

7. A wire rope comprising a solid polymeric core having an axis and a plurality of strands extending helically around the core, the core having a plurality of concave grooves which are equally spaced around the axis and consisting of a body of polymeric material having a structure orientated substantially in the direction of the grooves, the structure including whisker-like crystals which have a length extending substantially in the axial direction of the core and ribbon-like crystals each having a length extending substantially in the axial direction and a width extending substantially in a transverse direction normal to the axial direction wherein, before the core is incorporated in the wire rope, said grooves extend parallel to the axis of the core, and wherein, when the core is incorporated in the wire rope, said grooves extend helically and accommodate respective ones of said strands.

8. A wire rope as claimed in claim 7, in which there are six said strands on the core, the core having six said grooves.

9. A wire rope as claimed in claim 7, in which there are eight said strands on the core, the core having eight said grooves.

10. A wire rope as claimed in claim 7, in which the load bearing capability of the core is at least 5% of the load bearing capability of the wire rope.

* * * * *